US008646858B2

(12) United States Patent
Cappa

(10) Patent No.: US 8,646,858 B2
(45) Date of Patent: Feb. 11, 2014

(54) PRINTER FOR GROUPS OF PRODUCTS SUPPORTED ON A TABLE STRUCTURE

(75) Inventor: Paolo Cappa, Celle Ligure (IT)

(73) Assignee: Cabur S.R.L., Altare (SV) (IT)

( * ) Notice: Subject to any disclaimer, the term of this patent is extended or adjusted under 35 U.S.C. 154(b) by 295 days.

(21) Appl. No.: 13/065,539

(22) Filed: Mar. 24, 2011

(65) Prior Publication Data

US 2011/0249061 A1 Oct. 13, 2011

(30) Foreign Application Priority Data

Apr. 9, 2010 (IT) ..... MI2010A0603

(51) Int. Cl.
*B41J 3/00* (2006.01)

(52) U.S. Cl.
USPC ..... 347/4

(58) Field of Classification Search
None
See application file for complete search history.

(56) References Cited

U.S. PATENT DOCUMENTS 6,499,842 B1 12/2002 Kofman
6,536,345 B1 3/2003 Young

FOREIGN PATENT DOCUMENTS

EP 1 036 661 A2 9/2000

OTHER PUBLICATIONS

Italian Search Report dated Nov. 1, 2010.

*Primary Examiner* — Lamson Nguyen
(74) *Attorney, Agent, or Firm* — Hedman & Costigan, P.C.; James V. Costigan; Kathleen A. Costigan

(57) ABSTRACT

A printer (10) for groups of products (101) supported on a table structure (100) comprising at least one opening (11) for supplying the tables (100) and a plane (14) for advancing a single table (100) towards a printing head (15), in which the printing head (15) is mobile only in a direction parallel to the advancing plane (14) and that, at the printing head (15), means are provided for moving the table (100) with respect to the printing head (15) mobile between a first position, in which the table (100) is at a distal position with respect to the printing head (15), and a second position in which the table (100) is at a proximal position with respect to the printing head (15), in the second position the table (100) being at contact with an abutment (41) arranged at a predetermined distance with respect to the printing head (15).

10 Claims, 17 Drawing Sheets

PRINTER FOR GROUPS OF PRODUCTS SUPPORTED ON A TABLE STRUCTURE

The present invention refers to a printer for products supported on a table structure.

Currently, there are different types of printers for products which are gathered in groups constrained to a table structure.

Usually, in such printers, the abovementioned tables of products are supplied one by one and subsequently transported on a conveyor belt to a printing head.

Once the table reaches the printing head, the conveyor belt is stopped and the descent of the printing head is controlled up to a distance from the table predefined and suitable for the correct deposit of ink.

All currently known printers of the abovementioned type reveal drawbacks among which, in particular, frequent breakage of the printing head as well as the non-ideal deposit of the ink upon variation of the thickness of the supplied tables.

Both the abovementioned drawbacks derive from the movement of the printing head which, if not calibrated accurately each time the thickness of the tables is varied, could either lead to collisions between the head and the table or keep the distances between the two elements unsuitable for the correct deposit of the ink.

An object of the present invention is to provide a printer for products supported on a table capable of overcoming the aforementioned drawbacks of the prior art in an extremely simple, inexpensive and particularly functional manner.

Another object is to provide a printer for products supported on a table capable of avoiding any possible collision between the printing head and the table.

Another object is to provide a printer for products supported on a table in which, during the step of depositing the ink, the distance between the table and the printing head is always suitable for the correct deposit of ink regardless of the thickness of the table, without requiring any calibration of the printer. These objects according to the present invention are attained by providing a printer for products supported on a table as outlined in claim 1.

Further characteristics of the invention are outlined by the dependent claims.

Characteristics and advantages of a printer for products supported on a table according to the present invention shall be more apparent from the following exemplifying and non-limiting description with reference to the attached schematic drawings wherein.

Figure 1:
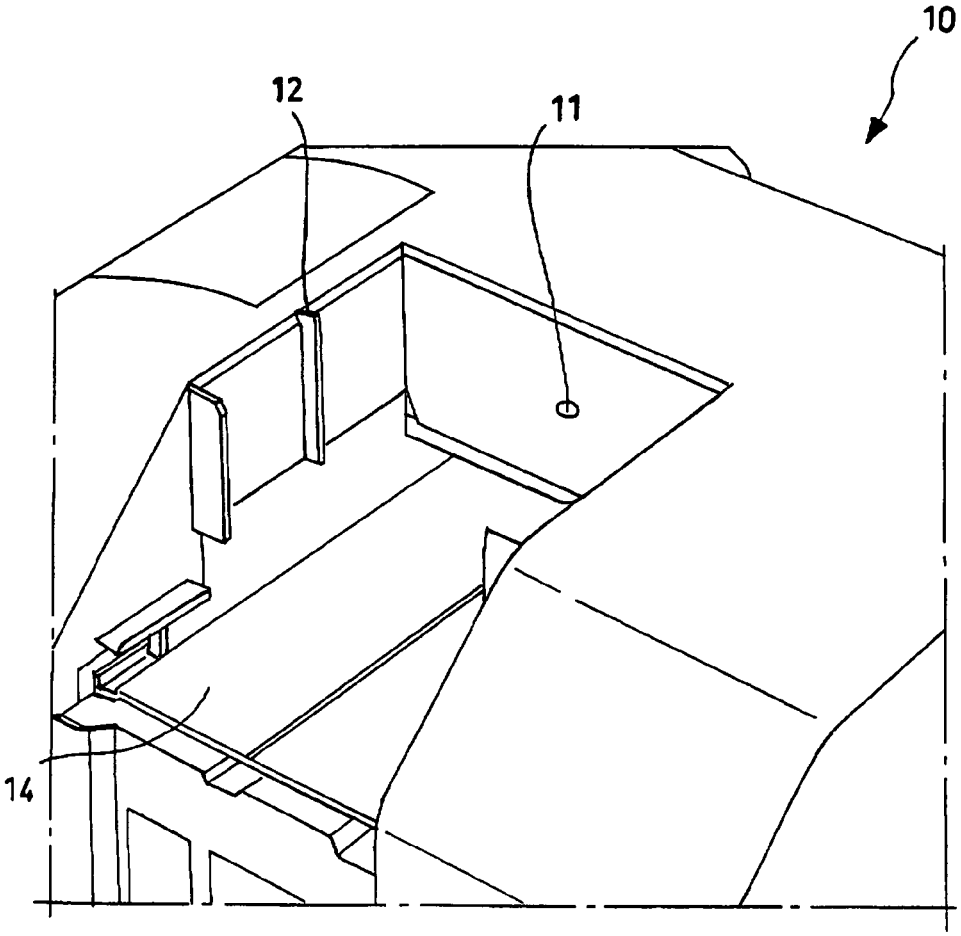
FIG. 1 is a partial perspective view of a printer according to the present invention.

With reference to the figures, an embodiment of a printer according to the present invention is shown with 10 and a table structure for supporting and supplying support groups in such printer 10 is shown with 100.

Such printer 10 comprises a housing 11, or loader, for receiving a plurality of tables 100 arranged one over the other, means for the orientation of the tables 100 in the housing 11, means 13 for supplying one table 100 at a time from the housing 11 to an advancing plane 14 towards a printing bead 15 and means for moving such single table 100 unloaded on the advancing plane 14.

Figure 3:
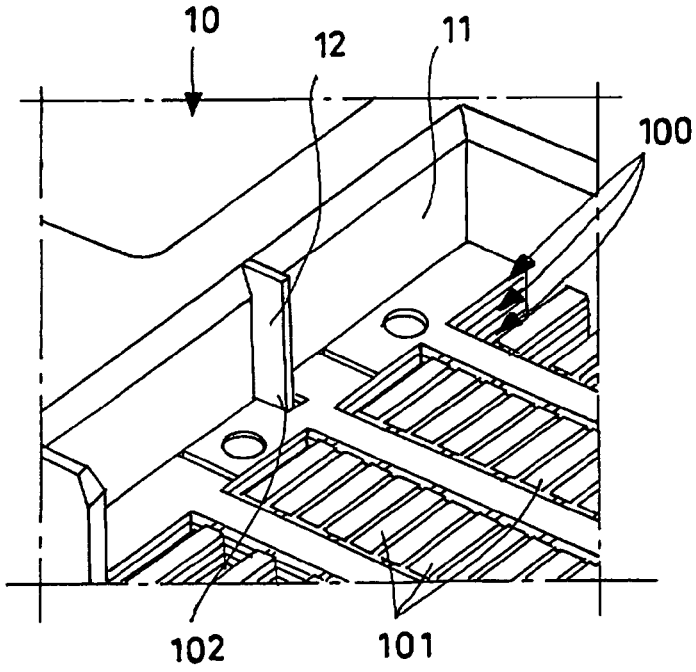
FIG. 3 is a perspective view of the printer of FIG. 1 loaded with a series of tables of FIG. 2.

A rib 12, observable in FIGS. 1 and 3, projecting within the housing 11 can be provided as means for the orientation of the tables 100 in the housing 11 with respect to the printer 10.

Figure 2:
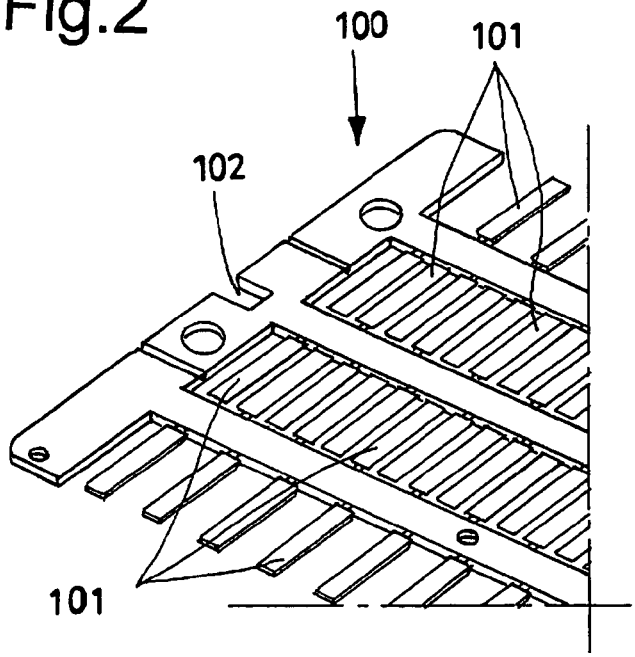
FIG. 2 is a partial perspective view of a table structure for supporting and supplying support groups in the printer of FIG. 1.

In particular, such rib 12 develops parallel to the direction of arrangement of the tables 100 placed one over the other and cooperates with a corresponding groove 102, shown in FIG. 2, obtained laterally with respect to the tables 100.

In FIG. 3 it is observable how the rib 12 engages the entire stack of tables 100, so that the tables 100 can be loaded in the printer 10 solely in a given direction.

This allows avoiding erroneously loading of the tables 100 in the printer 10.

In the present invention the means for supplying one table 100 at a time from the housing 11 to the advancing plane 14 towards said printing head 15 comprise leafing devices 13 arranged laterally and in a lower portion of the housing 11, so that the tables 100 inserted in the loader are supported on leafing devices without coming to contact with the plane 14, arranged partly beneath the housing.

In particular, such leafing devices 13 are mobile between a first extracted position, in which they maintain the stack of tables 100 lifted, and a second retracted position, in which they drop-release one table 100 at a time from the housing 11 to the advancing plane 14.

Figure 6C:
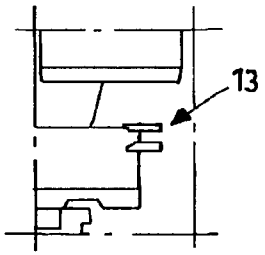
FIGS. 6, 6B, 6C, 6D, 6E show construction details of the printer of FIG. 1.
Figure 6:
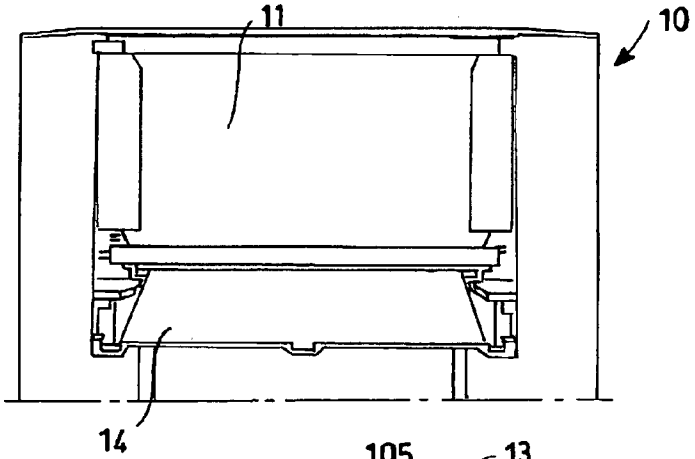
Figure 6B:
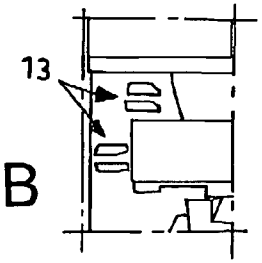
Figure 6D:
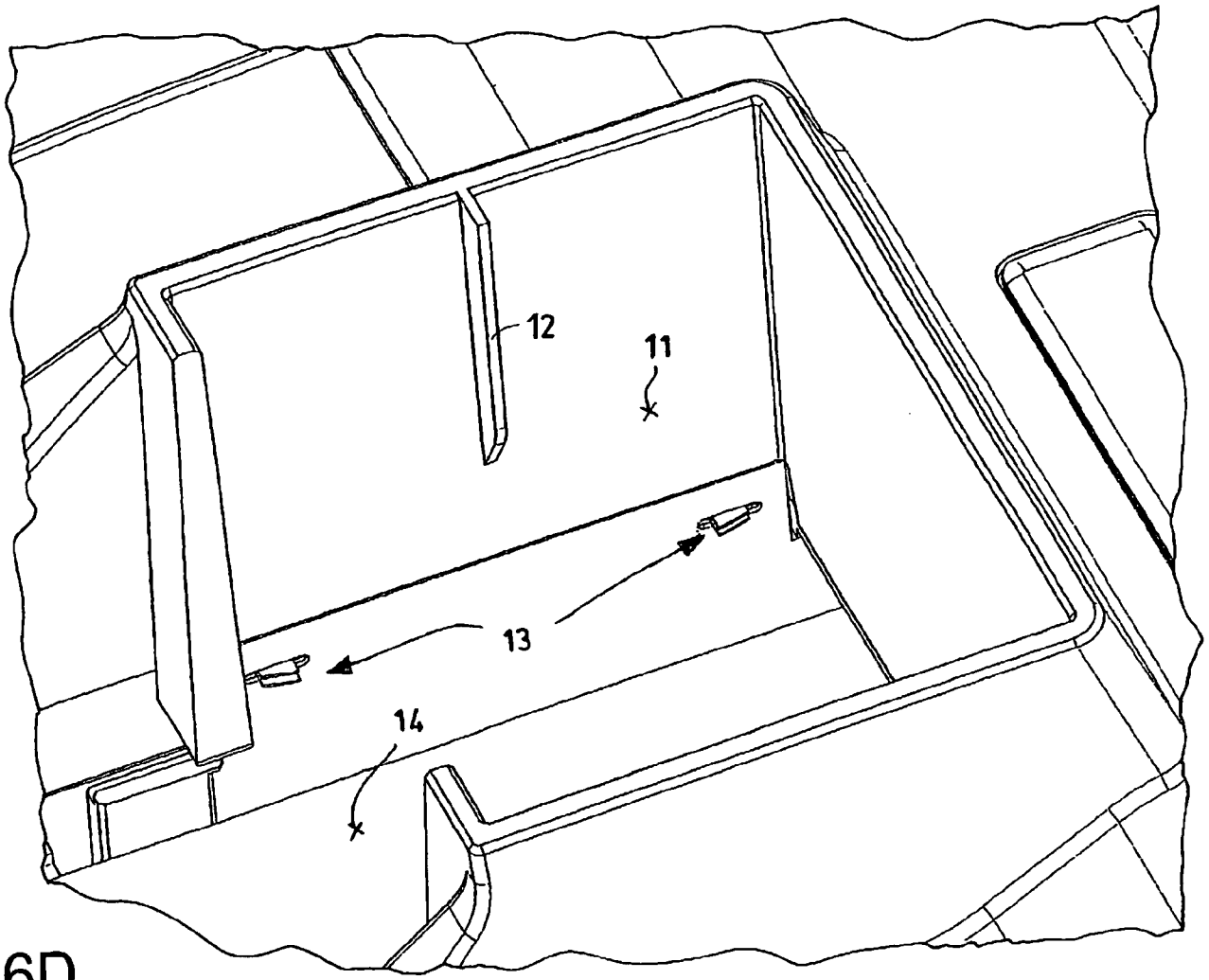
Figure 6E:
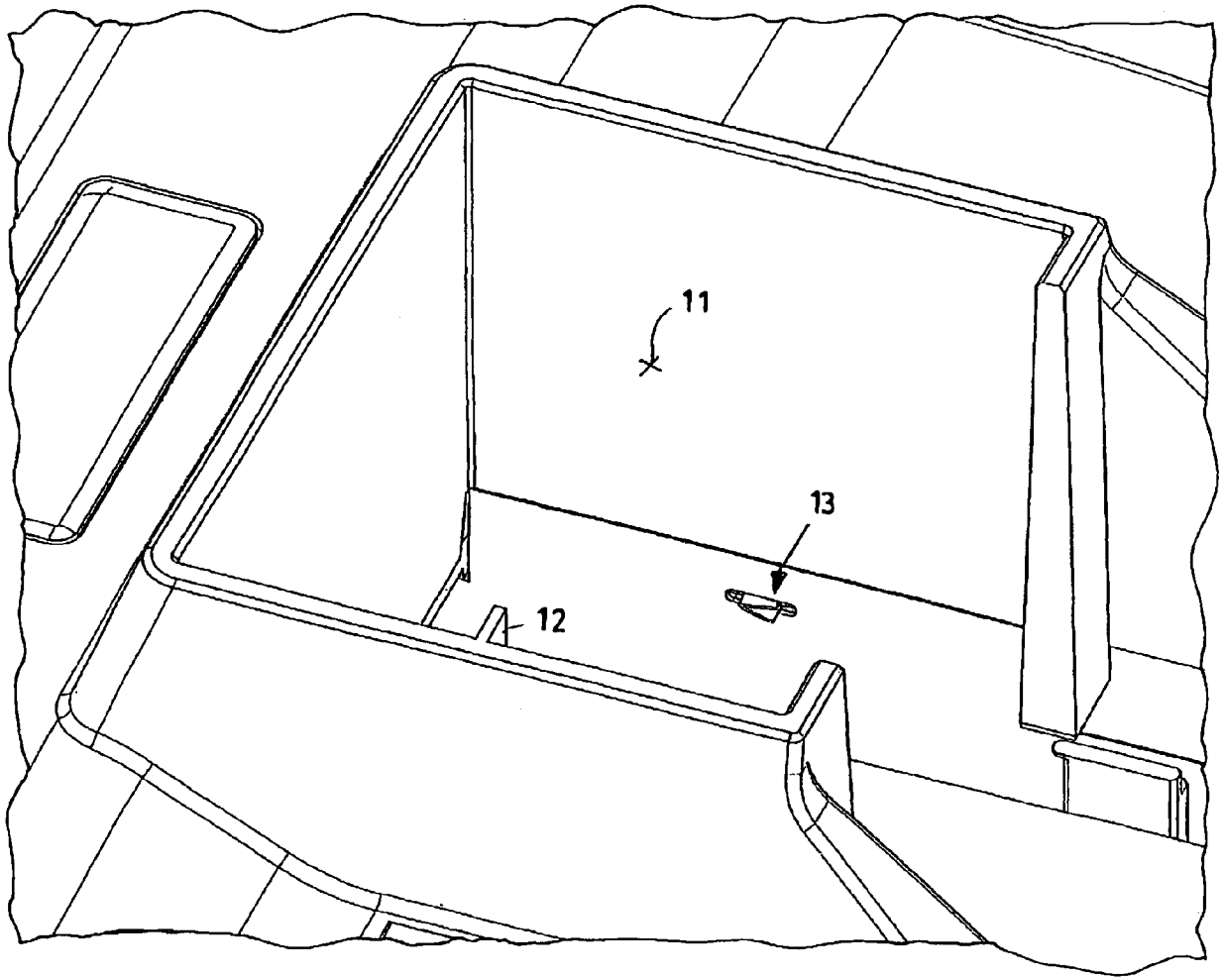
Figure 8:
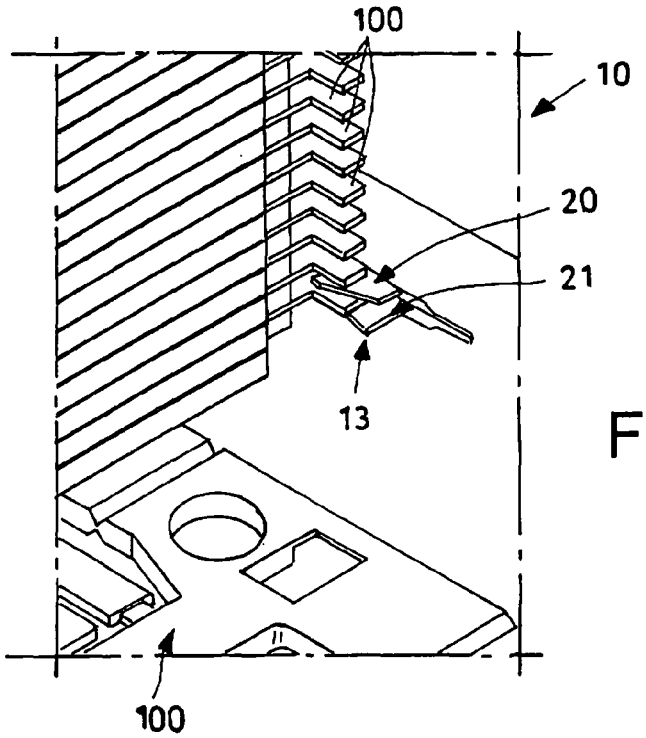
FIG. 8 shows the construction details of FIGS. 6, 6B, 6C during operation thereof.
Figure 9:
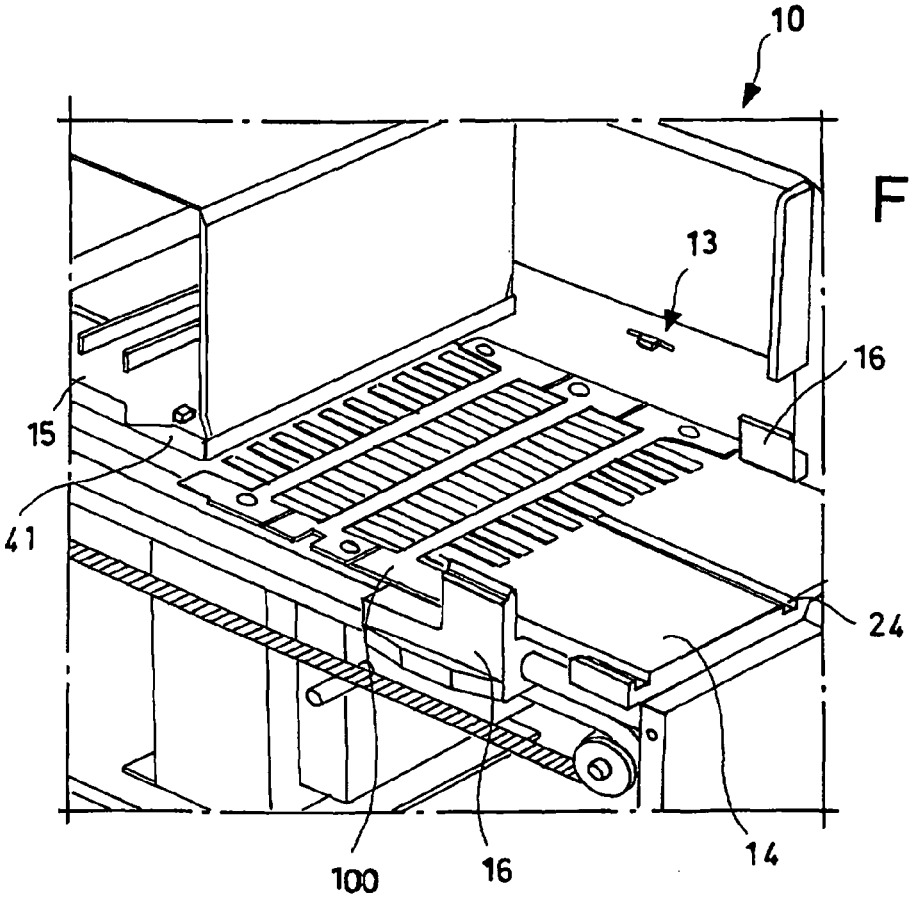
FIG. 9 shows a table during advancement within the printer of FIG. 1.
Figure 8B:
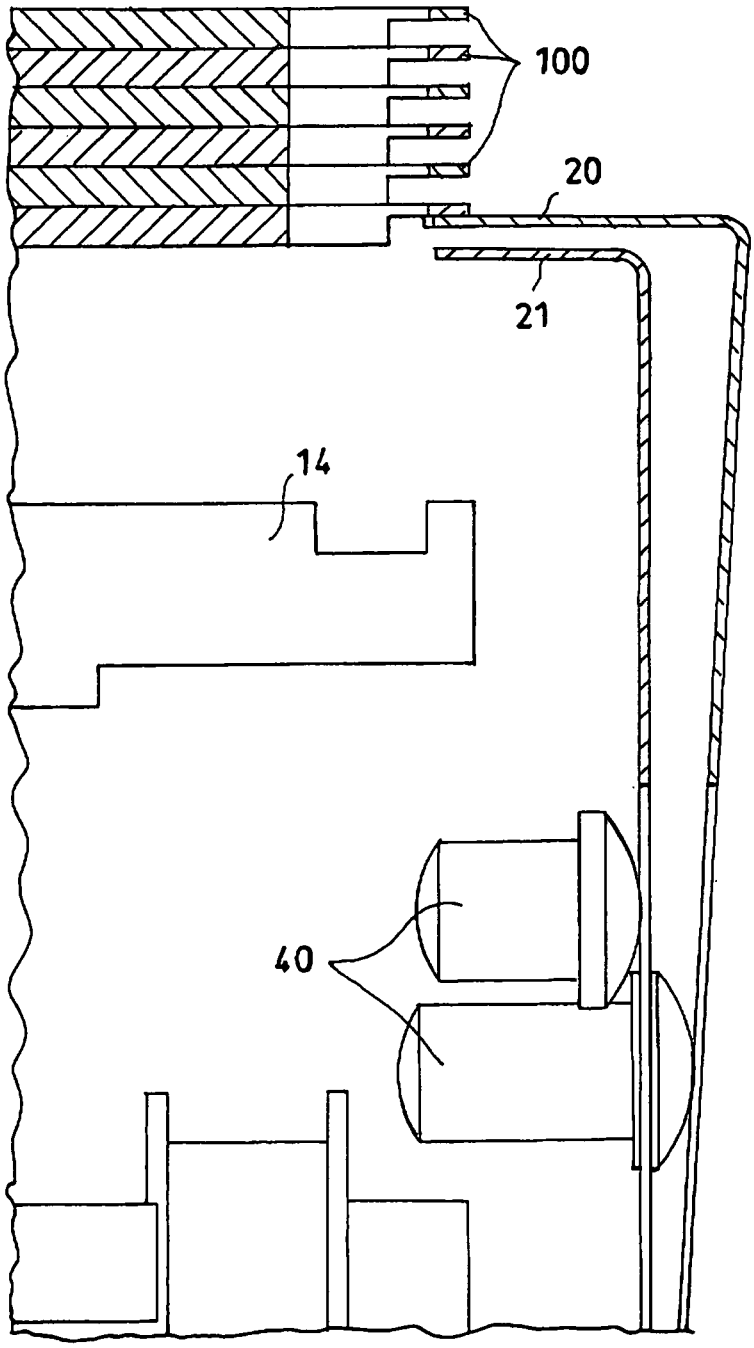
FIGS. 8B, 8C, 8D, 8E and 8F show various operating steps of the details shown in FIG. 8.
Figure 8C:
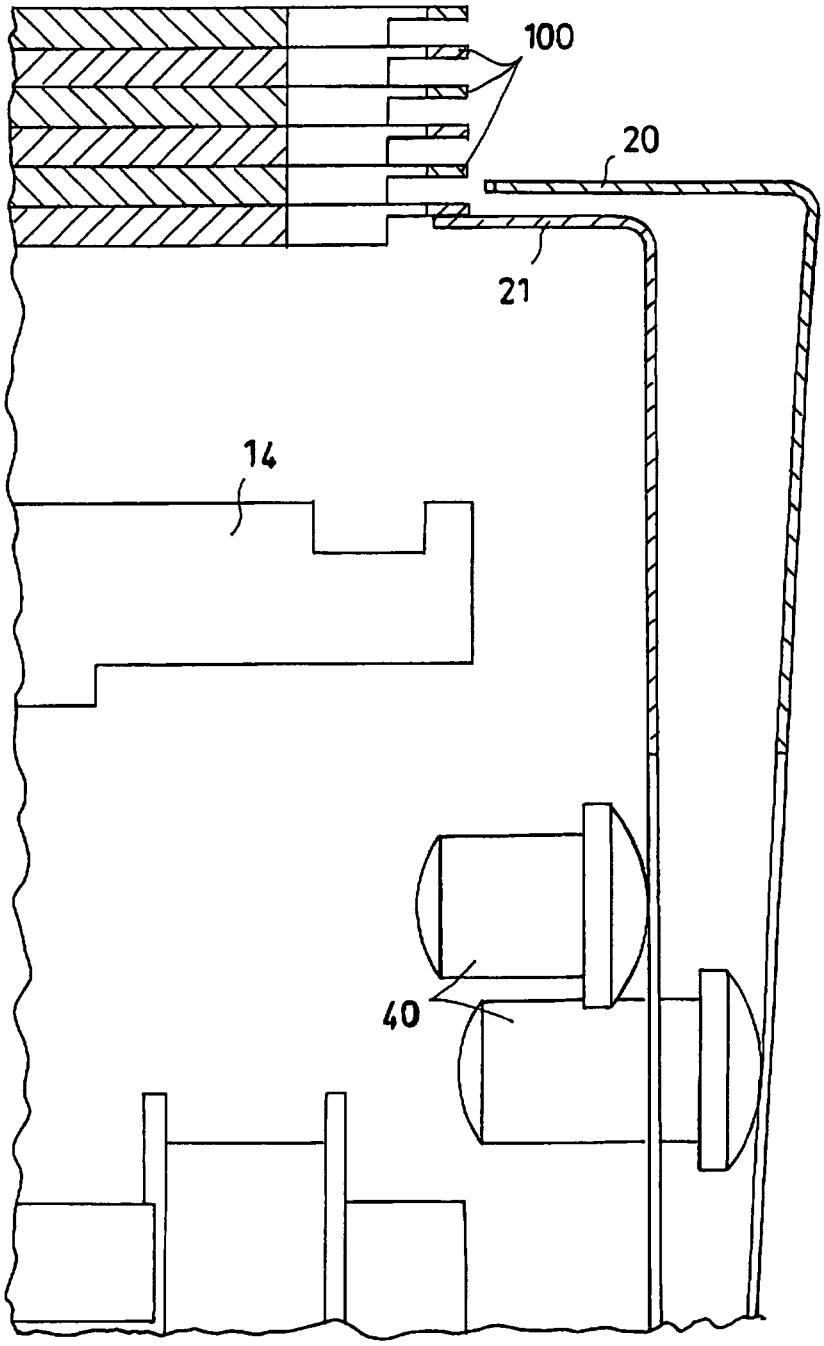
Figure 8D:
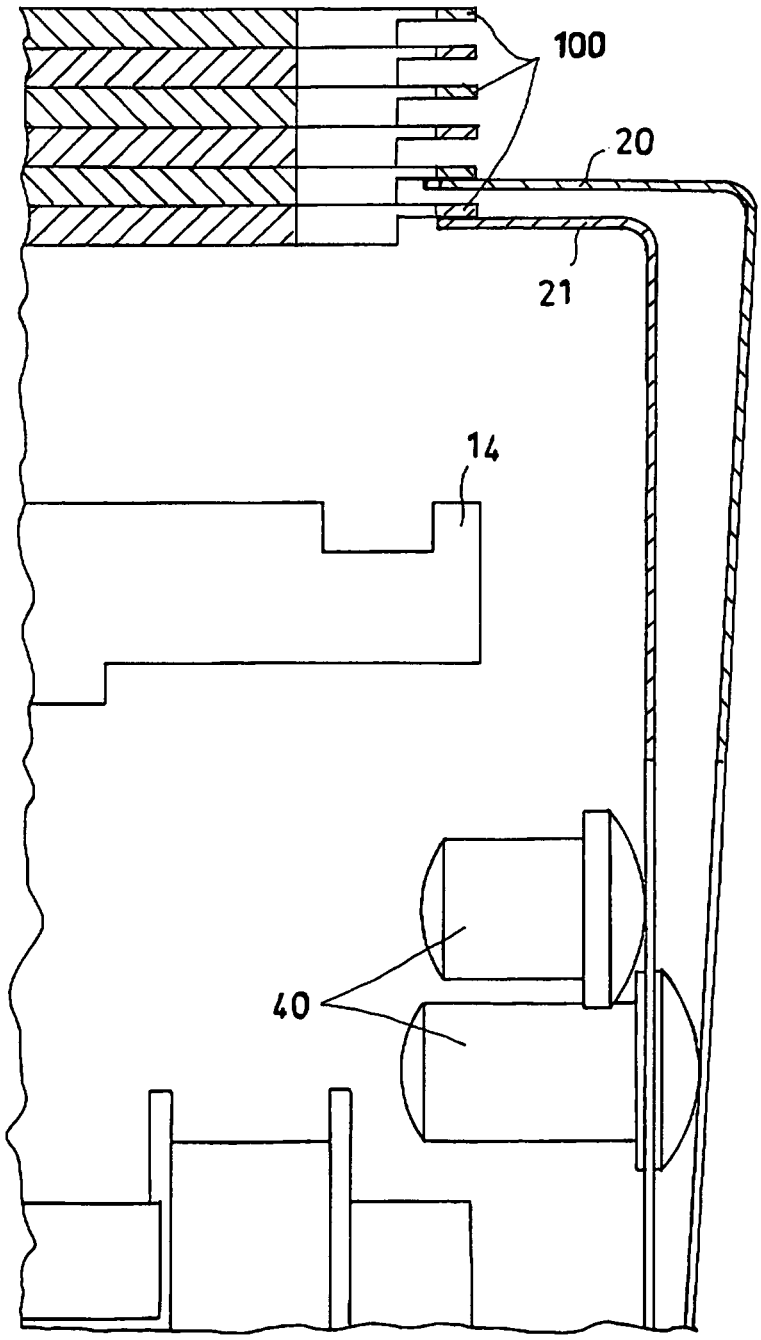
Figure 8E:
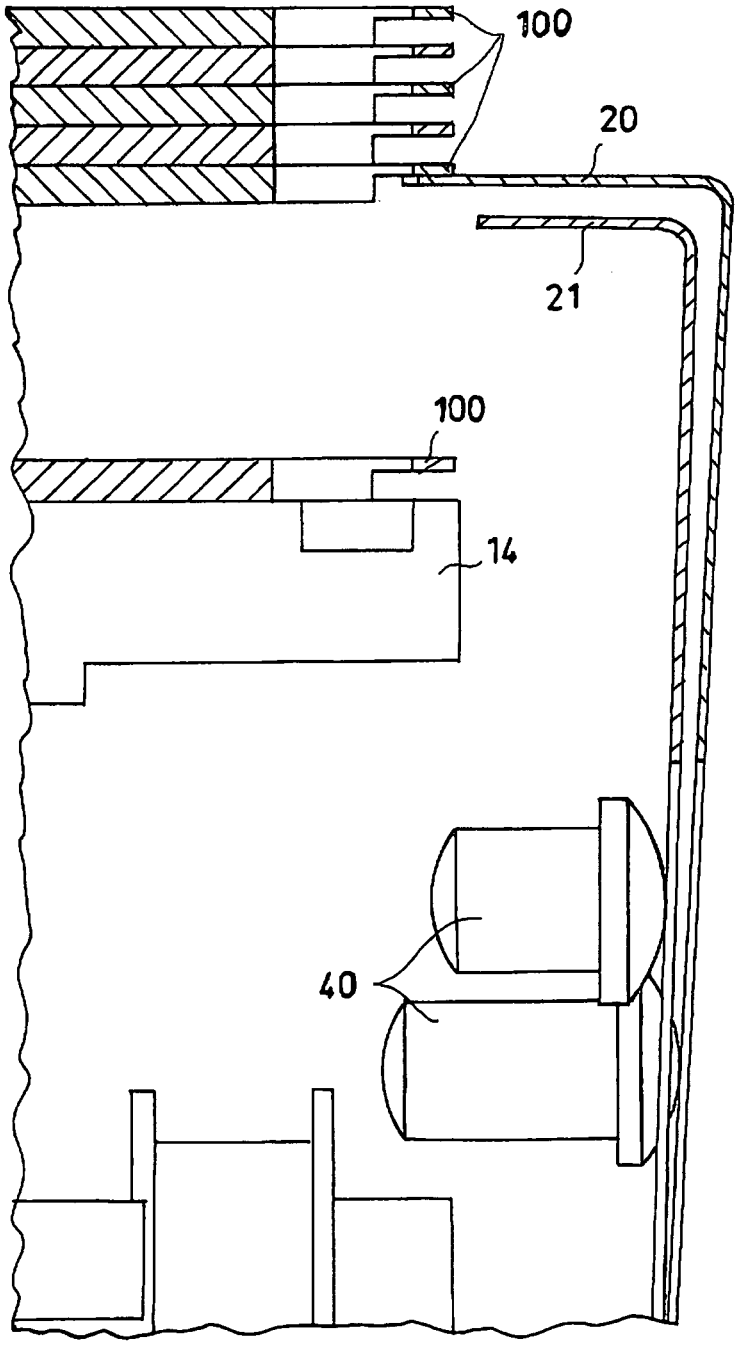
Figure 8F:
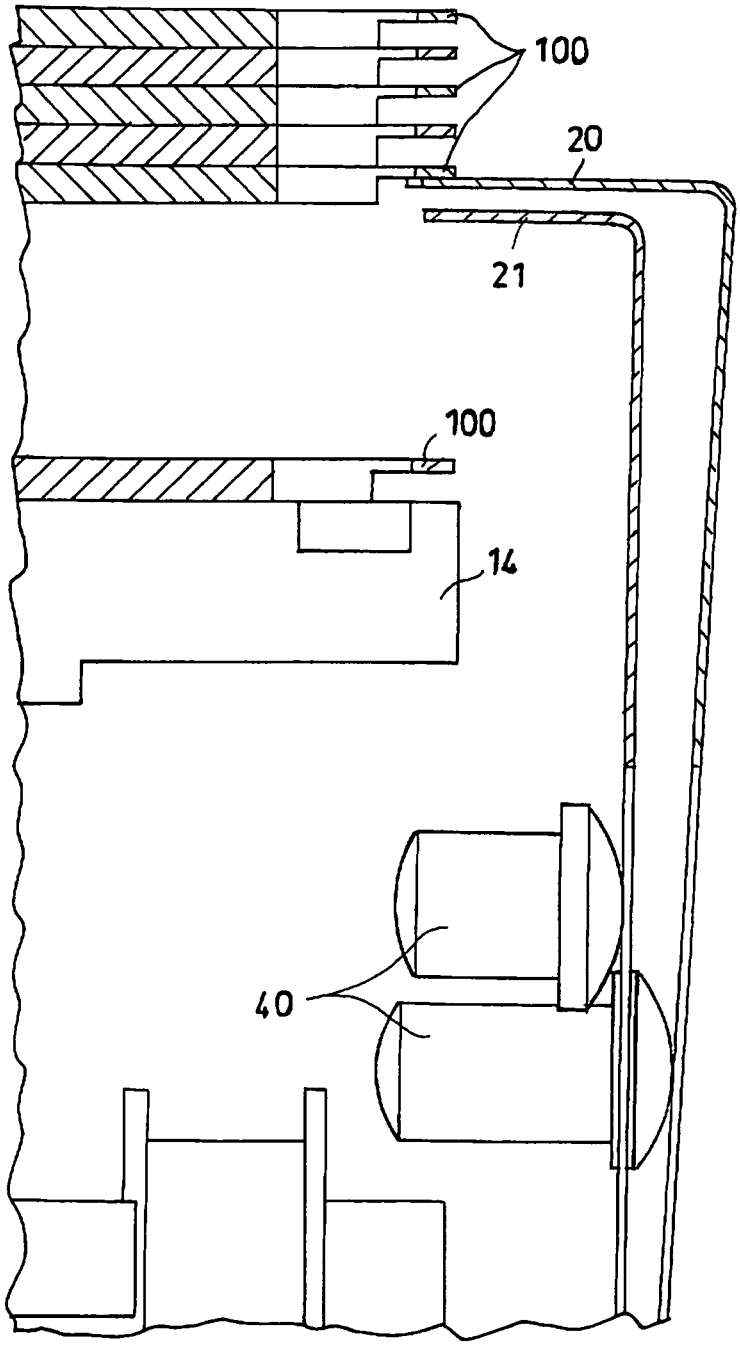
Figure 10:
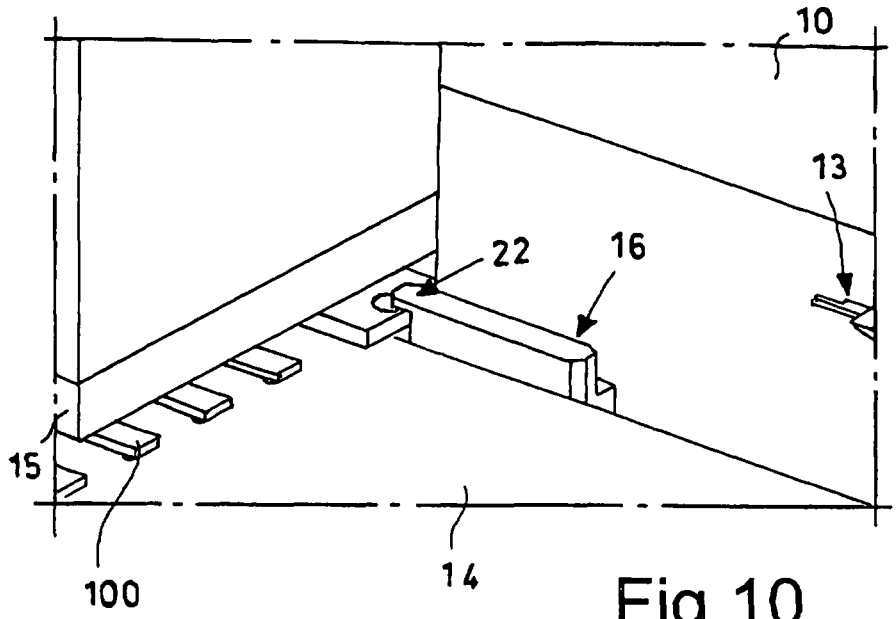
FIGS. 10, 11, 11B and 12 show other construction details of the printer of FIG. 1.
Figure 11:
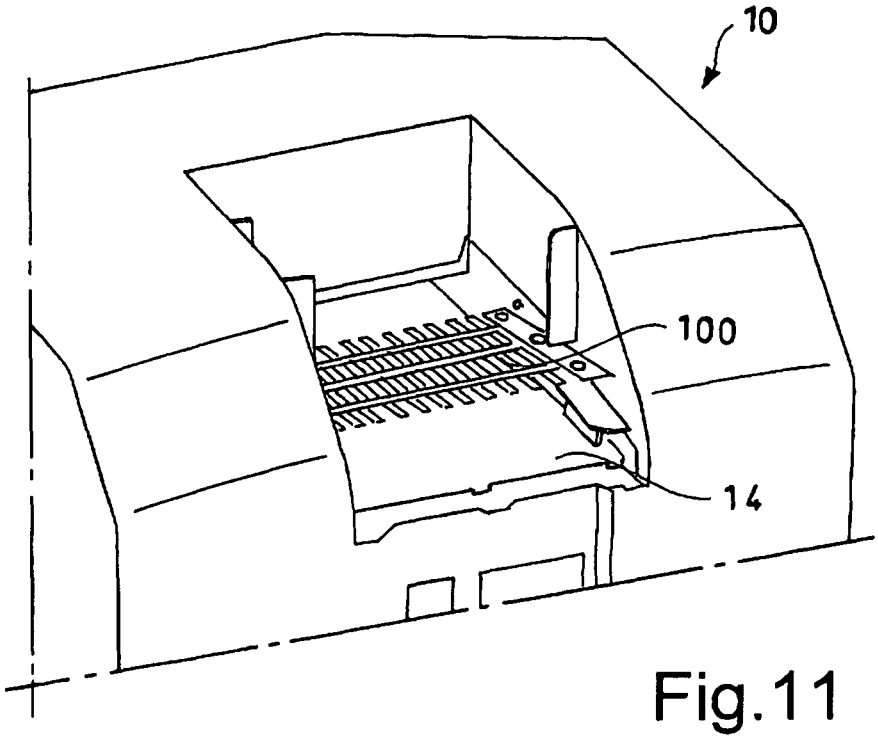
Figure 11B:
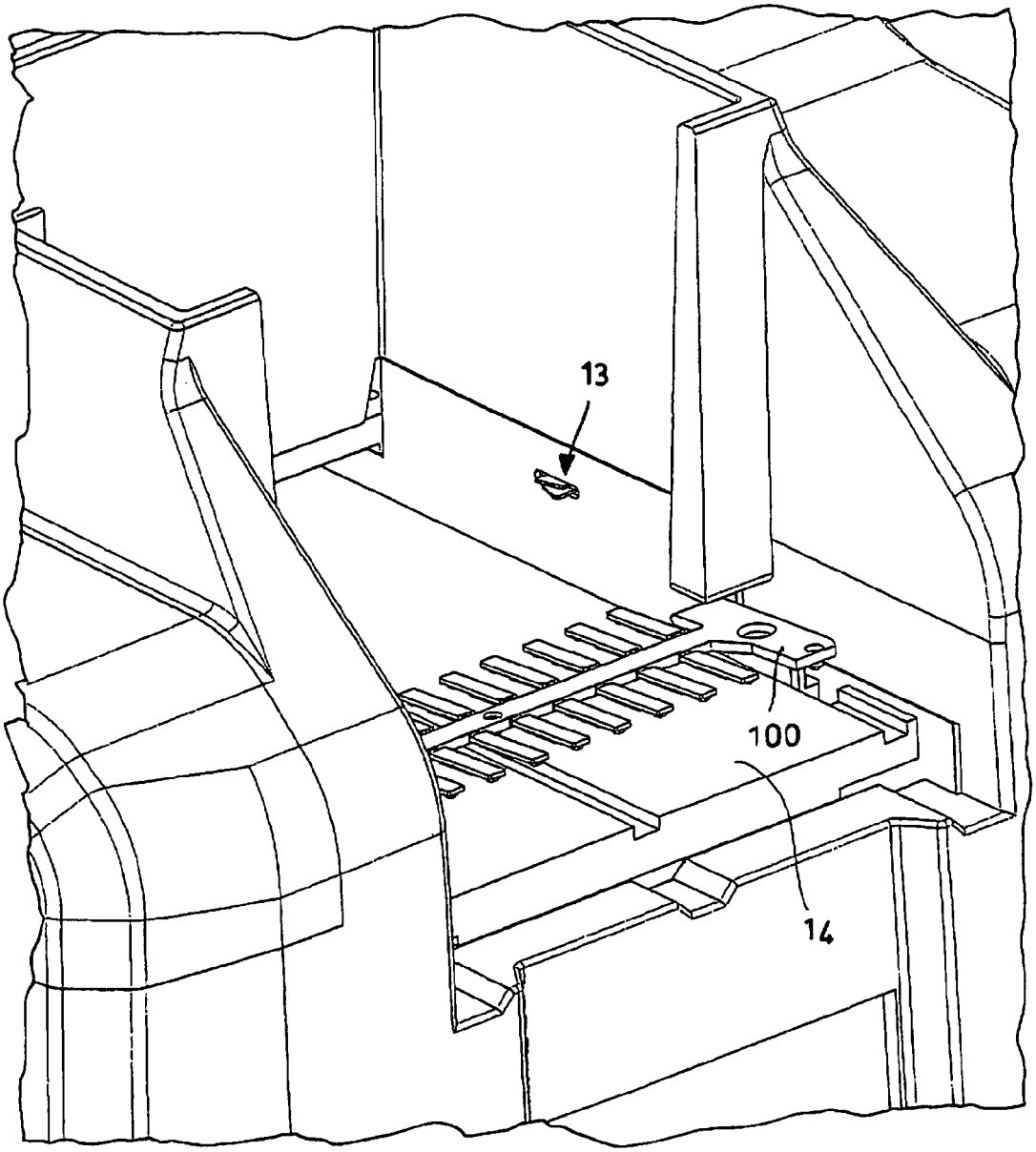

As observable in FIGS. 6B, 6C and 8, each of said leafing devices 13 comprises two blade elements 20, 21 arranged one over the other mobile independently.

Following a print command, the upper blade 20 recedes into the structure of the printer and the table 100 resting thereon descends supported by the surfaces with lower thickness 105 on the lower blade 21.

At this point, the upper blade 20 projects once again being positioned between the table 100 during the unloading step and the immediately upper one.

Simultaneously, or immediately thereafter, the lower blade 21 recedes dropping the table 100 to be printed from the housing 11 to the supply plane 14.

The abovementioned steps of coordinated movement of the blades 20 21 are shown in sequence in FIGS. 8B, 8C, 8D, 8E and 8F.

As shown in the abovementioned figures, preferably the movement of the blades 20 21 is carried out by means of cam pushers 40 operating independently, but in a synchronized manner, on the blades 20 21.

Figure 7:
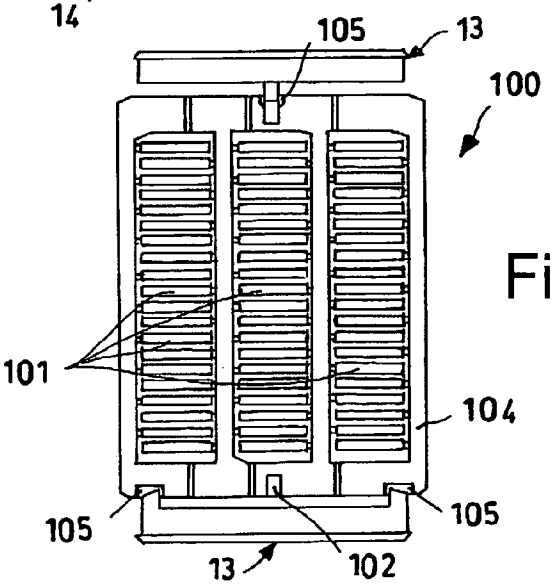
FIG. 7 shows the construction details of FIGS. 6, 6B, 6C during cooperation with a table.

As observable in FIG. 7, the leafing devices 13 are preferably three and arranged on the sides parallel to the printing direction, two of such leafing devices 13 being on one side and one on the opposite side at the recessions 105 in the tables 100.

The number thereof allows ensuring that the tables 100 always rest on all the leafing devices 13 present.

Pushing means 16 provided with portions 22 for restraining the tables 100 adherent to the advancing plane 14 are provided as means 16 for moving the single table 100 on the advancing plane 14.

Thus, the pushing means 16 push the table 100 towards the printing head 15 and simultaneously prevent the table 100 from lifting during the movement steps.

Upon completing the printing step, the pushing means 16 return to the initial position to receive a new table 100.

In order to make the printer 10 adaptable to different thickness of the tables 100 and to prevent inadvertent collisions of the printing head 15 with the table 100, the distance between the printing head 15 and the abutment 41 is fixed orthogonally to the advancing direction of the tables 100 and the advancing plane 14 is mobile orthogonally to the advancing direction of the tables 100 up to bringing the tables at contact against an abutment 41, in turn fixed at a predefined distance suitable for the correct deposit of ink on the table 100.

Thus, the abutment 41 prevents any possible collision of the printing head 15 with the table 100 and simultaneously blocks the tables 100 regardless of the thickness thereof still at a predefined distance suitable for the correct deposit of ink.

Thus, advantageously the machine does not require any calibration upon variation of the thickness of the supplied tables.

The printing head 15 of the present invention is mobile only parallel to the advancing plane 14 and blocked in the direction of approaching or moving away from the tables 100.

Thus, generally, the printer 10 for groups of products 101 supported on a table structure 100 according to the present invention comprises at least one opening 11 for supplying the tables 100 and means 16 for moving the tables 100 towards the printing head 15 and, at the printing head 15, means are provided for moving the tables 100 with respect to the printing head 15 mobile between a first position, in which the tables are at a distal position with respect to the printing head 15, and a second position in which the tables are at a proximal position with respect to the printing head 15. In such second position, the tables 100 are at contact with the abutment 41 arranged at a predetermined distance with respect to the printing head 15.

According to a preferred embodiment, also the abutment 41 can be mobile with respect to the printing head to offer the printer 10 a further adaptability to all types of tables.

The advancement of the table 100 on the plane 14 is also controlled by means of a guide 24 for receiving pins 106, 107 obtained on the lower surface of the tables 100, where such guide 24 narrows starting from the housing 11 towards the printing head 15 to perfectly centre the table 100 during printing.

Figure 4:
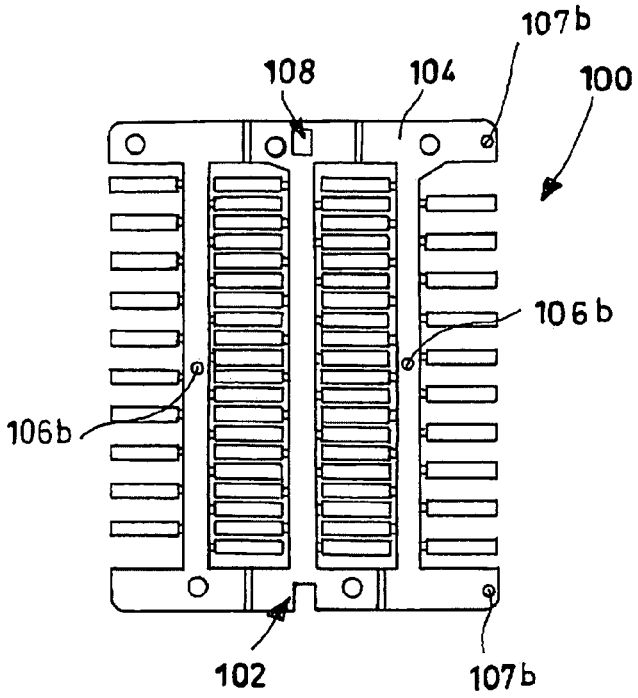
FIGS. 4, 4B, 5, 5B, 5C, 5D show different examples of table structures for supporting and supplying support groups in the printer of FIG. 1.
Figure 4B:
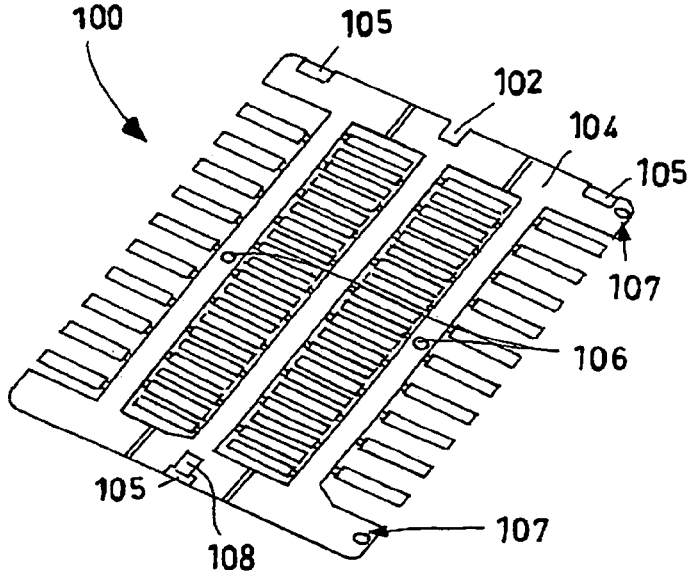
Figure 4C:
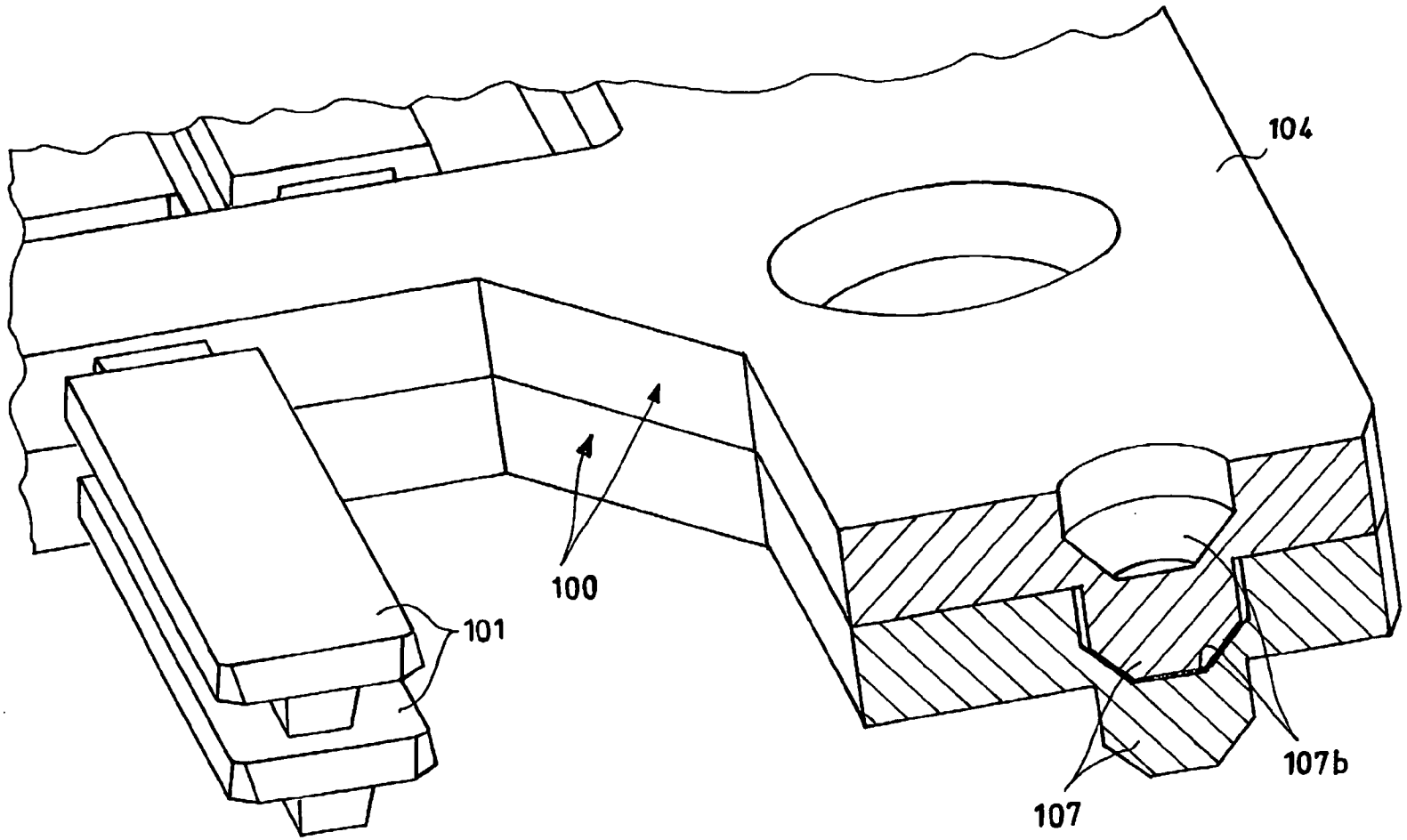
FIG. 4C shows stacked table structures.
Figure 5:
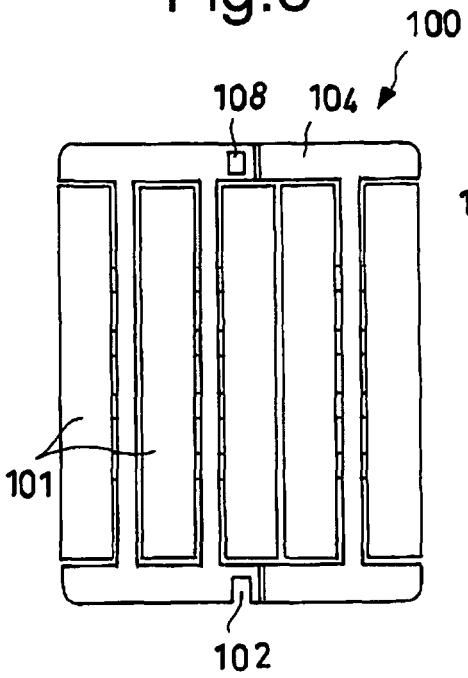
Figure 5B:
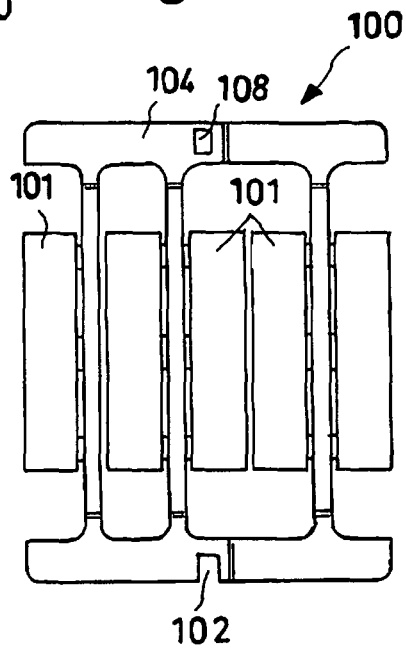
Figure 5C:
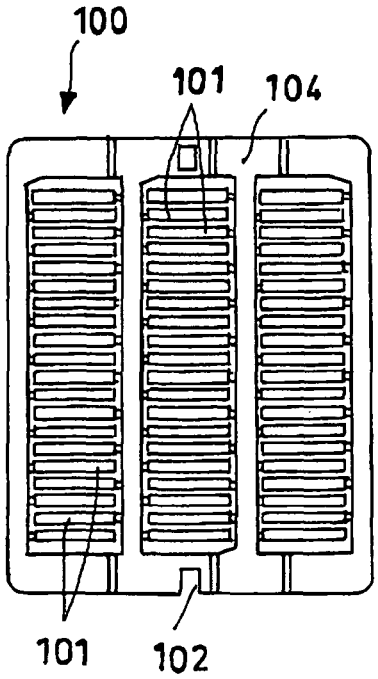
Figure 5D:
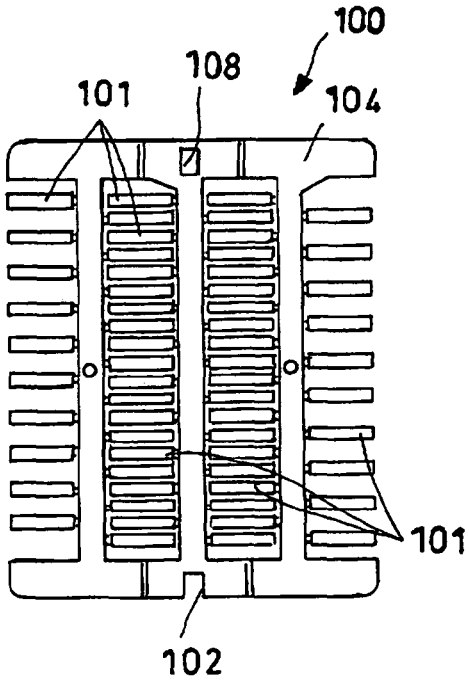

As shown in FIG. 4C, at the centring and sliding pins 106, 107 on the opposite side of the table 100 seats 106*b*, 107*b* are provided for receiving the pins 106, 107 to allow a stable placing of the tables 100 one over the other.

Figure 12:
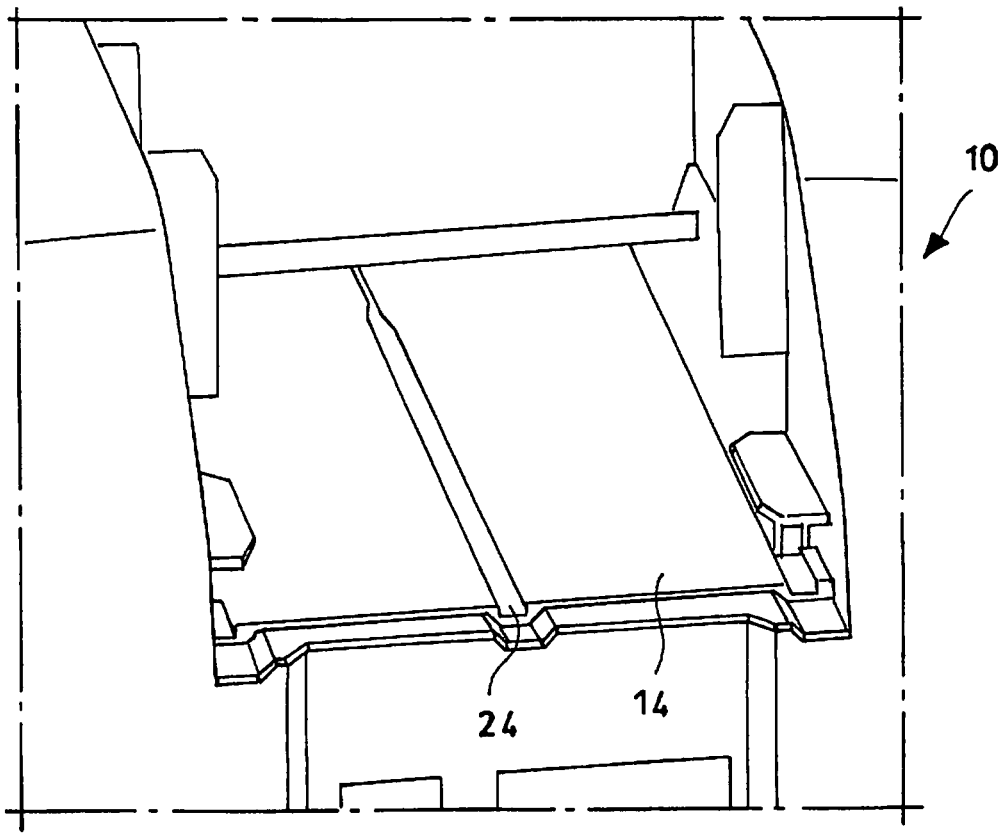

Lastly, in the printer 10 an area is also provided, shown in FIG. 12, for possible manual supply of the tables 100 or parts thereof on the plane 14. As partly evincible from the description of the printer, a table structure 100 for supporting and supplying products in such printer 10 is also an object of the present invention.

As observable in FIGS. 4, 4B, 5, 5B, 5C, 5D, such table structure 100 comprises a frame peripheral portion 104 for supporting a plurality of products 101 to be printed, where the frame 104 is provided with a groove 102 for coupling with the rib 12 of the housing 11, with areas having low thickness 105 for cooperation with the leafing devices 13, with sliding and centring pins 106 in the guide 24 obtained on the plane 14 and with pins 107 for centring the tables 100 with respect to each other in the housing 11.

Furthermore, the frame 104 may also comprise a hole 108 for moving the table 100.

Thus, the operation of a printer for products supported on a table subject of the invention is easy to understand.

Actually, during the step of depositing ink, the printing head is fixed orthogonally to the advancing direction of the tables and the table is moved towards such head up to contact with an abutment arranged at a predetermined distance from the printing head.

It has thus been observed that a printer and a table structure for supporting and supplying support groups in such printer according to the present invention attain the previously described objects.

Actually, during the step of depositing ink, the distance between the table and the printing head is always suitable for the correct deposit of ink regardless of the thickness of the table and without requiring any calibration of the printer.

The printer for products supported on a table of the present invention thus conceived is susceptible to numerous modifications and variants, all falling within the same inventive concept; furthermore, all details can be replaced by technically equivalent elements. In practice, the materials used as well as the dimensions thereof may vary according to the technical requirements.

The invention claimed is:

1. A printer (10) for groups of products (101) supported on a single table structure (100), said printer comprising at least an opening (11) for said single table structure (100) and an advancing plane (14) for moving said single table structure (100) towards a printing head (15), wherein said printing head (15) is only movable in a direction parallel to said advancing plane (14) and that, by said printing head (15), are positioned means for moving said single table structure (100) towards said printing head (15) from a first position, in which said table (100) is in a distal position with regard to the position of said printing head (15), and a second position in which said single table structure (100) is in a proximal position as regard to said printing head (15), wherein when said single table structure (100) is in said second position, said single table structure is in touch with an abutment (41) that is positioned at a predetermined distance from said printing head (15).

2. The printer (10) according to claim 1 wherein said abutment (41) is moveable with regard to said printing head (15).

3. The printer (10) according to claim 1 wherein said printer comprises a housing (11) for receiving a plurality of said single table structures (100) that are positioned one upon another, said housing (110 having means for orientation of said single table structures (100) in said housing (11) and means for supplying one single table structure (100) at a time from said housing (11) to said advancing plane (14) for moving said single table structure (100) towards said printer head (15).

4. The printer (10) according to claim 3 wherein said means for orientation of said single table structures (100) in said housing (11) with regard to said printer (10) comprise a rib (12) projecting from said housing (11) in a direction that is parallel to the direction that said tables (100) are placed one upon another, said rib (12) being in cooperation with a corresponding groove (102) that is positioned laterally in single table structures (100).

5. The printer (10) according to claim 4 wherein said means for supplying one single table structure (100) at a time from said housing (11) to said advancing plane (14) for moving said single table structure (100) towards said printing head, comprise leafing devices (13) placed laterally and in a lower portion of said housing (11), said leafing devices (13) being moveable between a first position in which they maintain the pile of said single table structures (100) in a lifted position from said advancing plane (14) and in a second position in which a single table structure drops (100) from said housing (11) on said advancing plane (14).

6. The printer (10) according to claim 5 wherein each of said leafing devices (13) comprise two independently moveable blade elements (20, 21) placed one on another.

7. The printer (10) according to claim 1 wherein said printer comprises pushing means (16) for said single table structures (100) on said advancing plane (14), said pushing means (16) being provided with restraining portions (22) for said single table structures (100) where said restraining portions (22) are adherent to said advancing plane (14).

8. The printer (10) according to claim 1 wherein said advancing plane (14) is orthogonally movable in the advancing direction of said single table structures (100) to said printing head (15).

9. The printer (10) according to claim 1 wherein said advancing plane (14) comprises a guide (24) for receiving pins (103) that are positioned on a lower surface of said single table structures (100).

10. The printer (10) according to claim 9 wherein said guide (24) narrows from said housing (11) towards said printer head (15).

* * * * *